US006180575B1

(12) United States Patent
Nipe

(10) Patent No.: US 6,180,575 B1
(45) Date of Patent: Jan. 30, 2001

(54) HIGH PERFORMANCE LUBRICATING OILS

(75) Inventor: Richard N. Nipe, Cherry Hill, NJ (US)

(73) Assignee: Mobil Oil Corporation, Fairfax, VA (US)

( * ) Notice: Under 35 U.S.C. 154(b), the term of this patent shall be extended for 0 days.

(21) Appl. No.: 09/358,514

(22) Filed: Jul. 22, 1999

Related U.S. Application Data

(60) Provisional application No. 60/095,322, filed on Aug. 4, 1998.

(51) Int. Cl.[7] ..... C10M 141/06; C10M 141/10
(52) U.S. Cl. ..... 508/227; 508/231
(58) Field of Search ..... 508/227, 231

(56) References Cited

U.S. PATENT DOCUMENTS

| | | | | |
|---|---|---|---|---|
| 4,064,059 | * | 12/1977 | Nebzydoski et al. | 508/227 |
| 4,511,481 | * | 4/1985 | Shim | 508/227 |
| 4,604,491 | * | 8/1986 | Dressler et al. | 585/7 |
| 4,620,048 | | 10/1986 | Ver Strate et al. | 585/10 |
| 4,626,368 | * | 12/1986 | Cardis | 508/227 |
| 4,714,794 | * | 12/1987 | Yoshida et al. | 585/13 |
| 4,956,122 | | 9/1990 | Watts et al. | 252/565 |
| 5,329,055 | | 7/1994 | Bachman et al. | 585/12 |
| 5,602,086 | | 2/1997 | Le et al. | 508/591 |
| 5,693,598 | | 12/1997 | Abraham et al. | 508/444 |
| 5,763,369 | | 6/1998 | Baumgart et al. | 508/183 |

OTHER PUBLICATIONS

Smalheer et al "Lubricant Additivies" p. 10, 1967.*
SHELLVIS VI Improvers (undated brochure).

* cited by examiner

*Primary Examiner*—Jacqueline V. Howard
(74) *Attorney, Agent, or Firm*—Malcom D. Keen; Charles J. Brumlik

(57) ABSTRACT

Lubricating oils useful as gear oils, circulating oils, compressor oils and in other applications characterized by and excellent balance of anti-wear and anti-rust characteristics are based on high quality base stocks including a major portion of a hydrocarbon base fluid such as a PAO with a secondary base stock component which is preferably a long chain alkylated aromatic, such as an alkylnaphthalene. A synergistic combination of additives comprising an adduct of a substituted triazole such as benzotriazole or a substituted benzotriazole, e.g. tolyltriazole (TTZ) with an amine phosphate and a trihydrocarbyl phosphate such as cresyl diphenylphosphate (CDP), confers the desired balance of anti-wear and anti-rust properties. In addition, the present oils typically include an anti-oxidant component and a rust inhibitor together with other optional additive components.

20 Claims, No Drawings

HIGH PERFORMANCE LUBRICATING OILS

CROSS REFERENCE TO RELATED APPLICATIONS

This application is the complete application based on provisional application Ser. No. 60/095,322, filed Aug. 4, 1998, the priority of which is claimed for the present application.

FIELD OF THE INVENTION

This invention relates to lubricating oils and more particularly to lubricating oils of synthetic or mineral oil origin which may be used for the lubrication of bearings, gears and in other industrial applications where wide temperature range characteristics are desired. The oils of the present invention are characterized by an excellent balance of performance properties including improved anti-wear characteristics coupled with ant-rust performance. They may find utility as gear oils, circulating oils, compressor oils as well as in other applications, for example, in wet clutch systems, blower bearings, coal pulverizer drives, cooling tower gearboxes, kiln drives, paper machine drives and rotary screw compressors.

BACKGROUND OF THE INVENTION

Gear oils and industrial oils are required to meet certain exacting performance specifications. They must exhibit long term stability, implying good resistance to oxidation over a wide range of temperatures coupled with other performance properties including good anti-wear performance. Depending upon the specific application, other performance characteristics may be required. For example, in high temperature circulating oils, high temperature stability must be the main requirement while minimum anti-rust performance is necessary since little water is present at high temperatures. However, in other applications, anti-rust performance becomes important, for example, in wet applications such as use in paper-making machinery.

The properties of oils may be differentiated on the basis of whether they are bulk properties which are not affected significantly by contact with the surface of other materials, for example, the components of a machine or surface-related properties which affect and are affected by the surfaces with which the oil is in contact Oxidation resistance, for instance, belongs largely in the fromer category although the rate at which an oil undergoes oxidation in use is affected by the character of the metal surfaces in contact with the oil. Extreme pressure resistance may also be included in this category. Other properties such as anti-corrosion, anti-rust, anti-wear are directly dependent on the nature of the surfaces—usually metal—with which the oil is in contact during use. The properties which are surface dependent impart another consideration into the formulation of a finished lubricant since the additives which are used to improve the properties of the lubricant base stock and provide the desired balance of properties may be in competition for available sites on the metal surface. For this reason, it is often difficult to obtain a good balance between the performance properties which are surface dependent. One instance of this is with anti-wear and anti-rust properties: it is difficult to produce an oil which possesses both properties in good measure at the same time.

Different types of base stocks have different performance characteristics. Ester base stocks, for example, the neopentyl polyol esters such as the pentaerythritol esters of monobasic carboxylic acids, have excellent high performance properties as indicated by their common use in gas turbine lubricants. They also provide excellent anti-wear characteristics when conventional anti-wear additives are present and they do not have any adverse effect on the performance of rust inhibitors. On the other hand, esters have relatively poor hydrolytic stability, undergoing hydrolysis readily in the presence of water at even moderate temperatures. They are, therefore, less well suited for use in wet applications such as paper-making machinery.

Hydrolytic stability can be improved by the use of hydrocarbon base stocks. The use of alkyl aromatics in combination with the other hydrocarbon base stocks such as hydrogenated polyalphaolefin (PAO) synthetic hydrocarbons and the improved hydrolytic stability of these combinations is described, for example, in U.S. Pat. No. 5,602,086, corresponding to EP 496 486. Traditional formulations containing PAO's, however, present other performance problems. Although the hydrolytic stability of hydrocarbon base stocks including PAOs is superior to that of the esters, it is frequently difficult to obtain a good balance of the surface-related properties such as anti-wear and anti-rust because, as noted above, these surface-related properties are dependent upon the extent to which the additives present in the base stock compete for sites on the metal surfaces which they are intended to protect and high quality hydrocarbon base stocks such as PAOs do not favorably interact with the additives used for this purpose. It is therefore continuing problem to produce a good combination of surface-related properties including anti-wear performance and anti-rust performance in synthetic oils based on hydrocarbon base stocks such as PAO's.

SUMMARY OF THE INVENTION

We have now developed lubricating oils based on hydrocarbon base stocks of synthetic or mineral oil origin which have an excellent combination of performance characteristics. These lubricants are characterized by an excellent balance of anti-wear and anti-rust characteristics. The anti-wear performance is indicated by a 4-Ball (ASTM D 4172) wear test value of not more than 0.35 mm maximum scar diameter (steel on steel) with values of not more than 0.30 mm being attainable, as well as by other excellent performance indicia, as described below. ASTM 4-Ball steel-on-bronze values of 0.07 mm wear scar diameter may be achieved. The rust inhibition performance is indicated by a Pass in ASTM D 665B with synthetic sea water. Excellent hydrolytic stability, high temperature performance, rust inhibition, corrosion inhibition, oxidation resistance and long oil life are all characteristics of the present oils, as described below.

Compositionally, the present synthetic oils comprise a major portion of a primary base stock component which is a saturated hydrocarbon component with which other lubricant base stock components may be blended. Base stock components which would generally be considered suitable for this purpose include the hydrocarbons such as those which are primarily saturated and which generally have viscosity indices about 110 or greater, a sulfur content generally below 0.3 weight percent and a total aromatics and olefinic content of below 10 weight percent each. Hydrocarbon base stock components of this type include the API Group III base stocks (as well as some oils in Group II), the Group IV base stocks (PAOs) as well as other synthetic hydrocarbon base stocks in API Group V. These components can optionally be combined with other blend components by the addition of hydrocarbyl substituted aromatics, such as the longer chain substituted aromatics. Preferred secondary base stock component are the oils of lubricating viscosity which are hydrocarbon substituted aromatic compounds, such as the long chain alkyl substituted aromatics, including the alkylated naphthalenes, alkylated benzenes, alkylated diphenyl compounds and alkylated diphenyl methanes. Typically, this secondary base stock component will comprise less than 50% of the total base stock with amounts up to no more than 25% being preferred.

A characteristic feature of the present compositions is that the excellent combination of anti-wear and anti-rust performance is achieved in the absence of an ester in the base stock although esters may optionally be included in order to improve certain properties, for example, haze. If this is done, the amount of ester will normally not exceed 10% of the base stock and usually no more than 5% is required in order to deal with any haze problems which may arise. Minor amounts of other materials may be present, either as intentional liquid components or as solvents or carrier fluids for additives.

A synergistic combination of additives confers the desired balance of anti-wear and anti-rust properties in the present compositions. This combination is a unique blend of an adduct of a substituted triazole such as benzotriazole or a substituted benzotriazole e.g. tolyltriazole (TTZ) with an aromatic amine phosphate, together with a trihydrocarbyl phosphate preferably a tri-aromatic substituted phosphate such as cresyl diphenylphosphate (CDP). The triazole/amine phosphate combinations have been found to impart excellent oxidation stability, anti-wear and anti-rust preventive performance to lubricant compositions but their effect is enhanced with the addition of the trihydrocarbyl phosphates, particularly where the hydrocarbon groups are aromatic as in CDP. In addition, the present oils typically include an anti-oxidant component together with other optional additive components such as one or more corrosion inhibitors, additional rust inhibitors, defoamants, chromophoric agents etc.

The present oils find utility as gear oils, circulating oils, compressor oils as well as in other applications, for example, wet clutch systems and blower bearings. In gear oil service they are useful for steel-on-steel (spur gear) as well as bronze-on-steel (worm gear) applications. Further industrial applications are described below.

DETAILED DESCRIPTION

Base Fluid

The present oils utilize a base fluid which comprises a primary hydrocarbon base stock component of lubricating viscosity. This component is also saturated in character with a viscosity index of 110 or greater, a sulfur content generally below 0.3 weight percent and a total aromatics and olefinic content of below 10 weight percent each. Hydrocarbon base stock components of this type include oils of mineral origin in API Group III (as well as certain oils in Group II), the Group IV synthetic base stocks (PAOs) and other synthetic hydrocarbon base stocks in API Group V. The preferred hydrocarbon base stock components of this type are the poly alpha olefins (PAOs) of API Group IV. At least 50% of the total lubricant comprises the primary hydrocarbon component and generally, the amount of this component is at least 60% of the total base stock. In preferred compositions, this component comprises at least 75% of the total composition.

This primary base stock component may be synthetic or of mineral oil origin although the synthetic materials are preferred. Suitable mineral oil stocks are characterized by a predominantly saturated (paraffinic) composition, relative freedom from sulfur and a high viscosity index (ASTM D 2270), greater than 110. Saturates (ASTM D 2007) are at least 90 weight percent and the controlled sulfur content is not more than 0.03 weight percent (ASTM D 2622, D 4294, D 4927, D 3120). Base stock components of this type of mineral oil origin include the hydroprocessed stocks, especially hydrotreated and catalytically hydrodewaxed distillate stocks, catalytically hydrodewaxed raffinates, hydrocracked and hydroisomerized petroleum waxes, including the lubricating oils referred to as XHVI oils, as well as other oils of mineral origin generally classified as API Group III base stocks. Exemplary streams of mineral origin which may be converted into suitable high quality base stocks by hydroprocessing techniques include waxy distillate stocks such as gas oils, slack waxes, deoiled waxes and microcrystalline waxes, and fuels hydrocracker bottoms fractions. Processes for the hydroisomerization of petroleum waxes and other feeds to produce high quality lubestocks are described in U.S. Pat. Nos. 5,885,438; 5,643,440; 5,358,628; 5,302,279; 5,288,395; 5,275,719; 5,264,116 and 5,110,445. The production of very high quality lubricant base stocks of high viscosity index from fuels hydrocracker bottoms is described in U.S. Pat. No. 5,468,368.

Synthetic hydrocarbon base stocks include the poly alpha olefins (PAOs) and the synthetic oils from the hydrocracking or hydroisomerization of Fischer Tropsch high boiling fractions including waxes. These are both stocks comprised of saturates with low impurity levels consistent with their synthetic origin. The hydroisomerized Fischer Tropsch waxes are highly suitable base stocks, comprising saturated components of iso-paraffinic character (resulting from the isomerization of the predominantly n-paraffins of the Fischer Tropsch waxes) which give a good blend of high viscosity index and low pour point. Processes for the hydroisomerization of Fischer Tropsch waxes are described in U.S. Pat. Nos. 5,362,378; 5,565,086; 5,246,566 and 5,135,638 as well as in EP 710710, EP 321302 and EP 321304.

The PAO's are known materials and typically comprise relatively low molecular weight hydrogenated polymers or oligomers of alphaolefins which include but are not limited to $C_2$ to about $C_{32}$ alphaolefins with the $C_8$ to about $C_{16}$ alphaolefins, such as 1-octene, 1-decene, 1-dodecene and the like being preferred. The preferred polyalphaolefins are poly-1-decene and poly-1-dodecene although the dimers of higher olefins in the range of $C_{14}$ to $C_{18}$ provide low viscosity base stocks.

The PAO fluids may be conveniently made by the polymerization of an alpha-olefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or U.S. Pat. No. 3,382,291 may be conveniently used herein. Other descriptions of PAO synthesis are found in the following U.S. Pat. Nos.: 3,742,082 (Brennan); 3,769,363 (Brennan); 3,876,720 (Heilman); 4,239,930 (Allphin); 4,367,352 (Watts); 4,413,156 (Watts); 4,434,408 (Larkin); 4,910,355 (Shubkin); 4,956,122 (Watts); 5,068,487 (Theriot). A particularly favorable class of PAO type base stocks are the High Viscosity Index PAOs (HVI-PAOs) prepared by the action of a reduced chromium catalyst with the alpha-olefin; the HVI-PAOs are described in U.S. Pat. Nos. 4,827,073 (Wu); and 4,827,064 (Wu); 4,967,032 (Ho et al.); 4,926,004

(Pelrine et al.); 4,914,254 (Pelrine). The dimers of the $C_{14}$ to $C_{18}$ olefins are described in U.S. Pat. No. 4,218,330.

The average molecular weight of the PAO typically varies from about 250 to about 10,000 with a preferred range of from about 300 to about 3,000 with a viscosity varying from about 3 cS to about 200 cS at 100° C. The PAO, being the majority component of the formulation will have the greatest effect on the viscosity and other viscometric properties of the finished product. Since the finished lubricant products are sold by viscosity grade, blends of different PAO's may be used to achieve the desired viscosity grade. Typically, the PAO component will comprise one or more PAO's of varying viscosities, usually with the lightest component being nominally a 2 cS (100° C.) component with other, more viscous PAO's also being present in order to give the final desired viscosity to the finished formulation. Typically, PAO's may be made in viscosities up to about 1,000 cS (100° C.) although in most cases, viscosity's greater than 100 cS will not be required except in minor amounts as viscosity index improvers.

In addition to the primary hydrocarbon component the base stock may also include a secondary liquid component with desirable lubricant properties. The preferred members of this class are the hydrocarbon substituted aromatic compounds, such as the long chain alkyl substituted aromatics. The preferred hydrocarbon substitutents for all these materials are, of course, the long chain alkyl groups with at least 8 and usually at least ten carbon atoms, to confer good solubility in the primary hydrocarbon blend component. Alkyl substituents of 12 to 18 carbon atoms are suitable and can readily be incorporated by conventional alkylation methods using olefins or other alkylating agents. The aromatic portion of the molecule may be hydrocarbon or non-hydrocarbon as in the examples given below.

Included in this class of base stock blend components are, for example, long chain alkylbenzenes and long chain alkyl naphthalenes which are particularly preferred materials since they are hydrolytically stable and may therefore be used in combination with the PAO component of the base stock in wet applications. The alkyinaphthalenes are known materials and are described, for example, in U.S. Pat. No. 4,714,794 (Yoshida et al.). The use of a mixture of monoalkylated and polyalkylated naphthalene as a base for synthetic functional fluids is also described in U.S. Pat. No. 4,604,491(Dressler). The preferred alkylnaphthalenes are those having a relatively long chain alkyl group typically from 10 to 40 carbon atoms although longer chains may be used if desired. Alkylnaphthalenes produced by alkylating naphthalene with an olefin of 14 to 20 carbon atoms has particularly good properties, especially when zeolites such as the large pore size zeolites are used as the alkylating catalyst, as described in U.S. Pat. No. 5,602,086, corresponding to EP 496 486 to which reference is made for a description of the synthesis of these materials. These alkylnaphthalenes are predominantly monosubstituted naphthalenes with attachment of the alkyl group taking place predominantly at the 1- or 2- position of the alkyl chain. The presence of the long chain alkyl groups confers good viscometric properties on the alkyl naphthalenes, especially when used in combination with the PAO components which are themselves materials of high viscosity index, low pour point and good fluidity.

An alternative secondary blending stock is an alkylbenzene or mixture of alkylbenzenes. The alkyl substituents in these fluids are typically alkyl groups of about 8 to 25 carbon atoms, usually from 10 to 18 carbon atoims and up to three such substituents may be present,as descried in ACS Petroleum Chemistry Preprint 1053–1058, "Poly n-Alkylbenzene Compounds: A Class of Thermally Stable and Wide Liquid Range Fluids", Eapen et al, Phila. 1984. Tri-alkyl benzenes may also be produced by the cydodimerization of 1-alkynes of 8 to 12 carbon atoms as described in U.S. Pat. No. 5,055,626. Other alkylbenzenes are described in EP 168 534 and U.S. Pat. No. 4,658,072. Alkylbenzenes have been used as lubricant base stocks, especially for low temperature applications (Arctic vehicle service and refrigeration oils) and in papermaking oils; they are commercially available from producers of linear alkylbenzenes (LABs) such as Vista Chem. Co, Huntsman Chemical Co. As well as Chevron Chemical co., and Nippon Oil Co. The linear alkylbenzenes typically have good low pour points and low temperature viscosities and VI values greater than 100 together with good solvency for additives. Other alkylated aromatics which may be used when desirable are described, for example, in "Synthetic Lubricants and High Performance Functional Fluids", Dressler, H., chap 5, (R. L. Shubkin (Ed.)), Marcel Dekker, N.Y. 1993.

Also included in this class and with very desirable lubricating characteristics are the alkylated aromatic compounds including the alkylated diphenyl compounds such as the alkylated diphenyl oxides, alkylated diphenyl sulfides and alkylated diphenyl methanes and the alkylated phenoxathins as well as the alkylthiophenes, alkyl benzofurans and the ethers of sulfur-containing aromatics. Lubricant blend components of this type are described, for example, in U.S. Pat. Nos. 5,552,071; 5,171,195; 5,395,538; 5,344,578; 5,371,248 and EP 815187.

The secondary component of the base stock is typically used in an amount no more than 40 wt. % of the total composition and in most cases will not exceed 25 wt. %. The alkyl naphthalenes are preferably used in amounts from about 5 to 25, usually 10 to 25 wt. %. Alkylbenzenes and other alkyl aromatics may be used in the same amounts although it has been found that the alkylnaphthalenes in some lubricant formulations are superior in oxidative performance in certain applications.

Although the present lubricants are usually hydrocarbon based compositions, they may make use of minor amounts of other base stocks in certain applications, for example, to improve haze, solvency or seal swell even though in most cases, the alkyl naphthalene component will provide good performance in these areas. Examples of additional base stocks which may be present include the polyalkylene glycols (PAGs), and ester oils, both of which are conventional in type. The amount of such additional components should not normally exceed about 5 weight percent of the total composition. If haze values need to be improved, the presence of up to about 5 weight percent ester will normally correct the problem.

The esters which may be used for this purpose include the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic add, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols such as the neopentyl polyols e.g. neopentyl glycol, trimethylol ethane, 2-methyl-2-propyl-1,3propanediol, trimethylol propane, pentaerythritol and dipentaerythritol with alkanoic adds containing at least 4 carbon atoms such as the, normally the $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid.

The most suitable synthetic ester oils are the esters of trimethylol propane, trimethylol butane, trimethylol ethane, pentaerythritol and/or dipentaerythritol with one or more monocarboxylic acids containing from about 5 to about 10 carbon atoms are widely available commercially, for example, the Mobil P-41 and P-51 esters (Mobil Chemical Company).

The viscosity grade of the final product is adjusted by suitable blending of base stock components of differing viscosities, together with the use of thickeners, if desired. Differing amounts of the various basestock components (primary hydrocarbon base stocks, secondary base stock and any additional base stock components) of different viscosities, may be suitably blended together to obtain a base stock blend with a viscosity appropriate for blending with the other components of the finished lubricant. The viscosity grades for the final product may typically be in the range of ISO 20 to ISO 1000 or even higher for gear lubricant applications, for example, up to about ISO 46,000. For the lower viscosity grades, typically from ISO 20 to ISO 100, the viscosity of the combined base stocks will be slightly higher than that of the finished product, typically from ISO 22 to about ISO 120 but in the more viscous grades up to ISO 46,000, the additives will frequently decrease the viscosity of the base stock blend to a slightly lower value. With a ISO 680 grade lubricant, for example, the base stock blend might be about 780–800 cS (40° C.) depending on the nature and content of the additives.

Thickners

The viscosity of the final product may be brought to the desired grade by the use of polymeric thickeners especially in the product with the more viscous grades, e.g. from ISO 680 to ISO 46,000. Typical thickeners which may be used include the polyisobutylenes, as well as ethylene-propylene polymers, polymethacrylates and various diene block polymers and copolymers, polyolefins and polyalkylstyrenes. These thickeners are commonly used as viscosity index improvers (VIIs) or viscosity index modifiers (VIMs) so that members of this class conventionally confer a useful effect on the temperature-viscosity relationship. These components may be blended according commercial market requirement, equipment builder specifications to produce products of the final desired viscosity grade. Typical commercially available viscosity index improvers are polyisobutylenes, polymerized and co-polymerized alkyl methacrylates, and mixed esters of styrene maleic anhydride interpolymers reacted with nitrogen containing compounds.

The polyisobutenes, normally with a molecular weight from 10,00 to 15,000, are a commercially important class of VI improvers and generally confer strong viscosity increases as a result of their molecular structure. The diene polymers which are normally copolymers of 1,3-dienes such as butadiene or isoprene, either alone or copolymerized with styrene are also an important class commercially, with typical members of this class sold under names such as Shelivis™. The statistical polymers are usually produced from butadiene and styrene while the block copolymers are normally derived from butadiene/isoprene and isoprene/styrene combinations. These polymers are normally subjected to hydrogenation to remove residual diene unsaturation and to improve stability. The polymethacrylates, normally with molecular weights from 15,000 to 25,000, represent another commercially important class of thickeners and are widely commercially available under designations such as Acryloid™.

One class of polymeric thickeners is the block copolymers produced by the anionic polymerization of unsaturated monomers including styrene, butadiene, and isoprene. Copolymers of this type are described in U.S. Pat. Nos. 5,187,236; 5,268,427; 5,276,100; 5,292,820; 5,352,743; 5,359,009; 5,376,722 and 5,399,629. Block copolymers may be linear or star type copolymers and for the present purposes, the linear block polymers are preferred. The preferred polymers are the isoprene-butadiene and isoprene-styrene anionic diblock and triblock copolymers. Particularly preferred high molecular weight polymeric components are the ones sold under the designation Shelivis™ 40, Shelivis™ 50 and Shelivis™ 90 by Shell Chemical Company, which are linear anionic copolymers. Of these, Shellvis™ 50 is an anionic diblock copolymer and Shellvis™ 200, Shellvis™ 260 and Shelivis™ 300 are star copolymers.

Some thickeners may be classified as dispersant-viscosity index modifiers because of their dual function, as described in U.S. Pat. No. 4,594,378. The dispersant-viscosity index modifiers disclosed in the '378 patent are the nitrogen-containing esters of carboxylic-containing interpolymers and the oil-soluble acrylate-polymerization products of acrylate esters, alone or in combination. Commercially available dispersant-viscosity index modifiers are sold under trade names Acryloid™1263 and 1265 by Rohm and Haas, Viscoplex™ 5151 and 5089 by Rohm-GMBHO™ Registered TM and Lubrizol™ 3702 and 3715.

An excellent discussion of types of high molecular weight polymers which may be used as thickeners or VI improvers is given by Klamann, *Lubricants and Related Products,* Klamann, Verlag Chemie, Weinheim 1984, ISBN 3-527-26022-6 and Deerfield Beach, Fla. 0-89573-177-0 (English transl) which also gives a good discussion of other lubricant additives, as mentioned below. Reference is also made "*Lubricant Additives*" by M. W. Ranney, published by Noyes Data Corporation of Parkridge, N.J. (1973).

Antioxidants

Oxidation stability is provided by the use of antioxidants and for this purpose a wide range of commercially available materials is suitable. The most common types of antioxidant which may be used in the present compositions are the phenolic antioxidants, the amine type antioxidants, the alkyl aromatic sulfides, phosphorus compounds such as the phosphites and phosphonic acid esters and the sulfur-phosphorus compounds such as the dithiophosphates and other types such as the dialkyl dithiocarbamates, e.g. methylene bis(di-n-butyl) dithiocarbamate. They may be used individually by type or in combination with one another. Mixtures of different types of phenols or amines are particularly useful.

The sulfur compounds which exhibit antioxidant performance include the dialkyl sulfides such as dibenzyl sulfide, polysulfides, diaryl sulfides, modified thiols, mercaptobenzimidazoles, thiophene derivatives, xanthogenates, and thioglycols. Materials of this type as well as other antioxidants which may be used are described in *Lubricants and Related Products,* Klamann, op cit.

The phenolic antioxidants which may be used in the present lubricants may suitably be ashless (metal-free) phenolic compounds or neutral or basic metal salts of certain phenolic compounds. The amount of phenolic compound incorporated into the lubricant fluid may vary over a wide range depending upon the particular utility for which the phenolic compound is added. In general, from about 0.1 to about 10% by weight of the phenolic compound will be included in the functional fluid. More often, the amount is from about 0.1 to about 5%, e.g. 2%, by weight.

The preferred phenolic compounds are the hindered phenolics which are the ones which contain a sterically hindered hydroxyl group, and these include those derivatives of dihydroxy aryl compounds in which the hydroxyl groups are in the o-or p-position to each other. Typical phenolic antioxidants include the hindered phenols substituted with $C_6$+ alkyl groups and the alkylene coupled derivatives of these hindered phenols. Examples of phenolic materials of this type 2-t-butyl4-heptyl phenol; 2-t-butyl4-octyl phenol; 2-t-butyl4-dodecyl phenol; 2,6di-t-butyl-4-heptyl phenol; 2,6di-t-butyl-4dodecyl phenol; 2-methyl-6di-t-butyl-4-heptyl phenol; and 2-methyl-6-di-t-butyl-4-dodecyl phenol. Examples of ortho coupled phenols include: 2,2'-bis(6t-butyl-4-heptyl phenol); 2,2'-bis(6-t-butyl-4-octyl phenol); and 2,2'-bis(6-t-butyl4-dodecyl phenol). Sulfur containing phenolics can also be used to great advantage. The sulfur can be present as either aromatic or aliphatic sulfur within the phenolic antioxidant molecule.

Non-phenolic oxidation inhibitors, especially the aromatic amine antioxidants may also be used either as such or in combination with the phenolics. Typical examples of non-phenolic antioxidants include: alkylated and non-alkylated aromatic amines such as the aromatic monoamines of the formula $R^3R^4R^5N$ where $R^3$ is an aliphatic, aromatic or substituted aromatic group, $R^4$ is an aromatic or a substituted aromatic group, and $R^5$ is H, alkyl, aryl or $R^6S(O)xR^7$ where $R^6$ is an alkylene, alkenylene, or aralkylene group, $R^7$ is a higher alkyl group, or an alkenyl, aryl, or alkaryl group, and x is 0, 1 or 2. The aliphatic group $R^3$ may contain from 1 to about 20 carbon atoms, and preferably contains from 6 to 12 carbon atoms. The aliphatic group is a saturated aliphatic group. Preferably, both $R^3$ and $R^4$ are aromatic or substituted aromatic groups, and the aromatic group may be a fused ring aromatic group such as naphthyl. Aromatic groups $R^3$ and $R^4$ may be joined together with other groups such as S.

Typical aromatic amines antioxidants have alkyl or aryl substituent groups of at least 6 carbon atoms. Examples of aliphatic groups include hexyl, heptyl, octyl, nonyl, and decyl. Examples of aryl groups include styrenated or substituted-styrenated groups. Generally, the aliphatic groups will not contain more than 14 carbon atoms. The general types of amine antioxidants useful in the present compostions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyidiphenylamine; octylphenyl-beta-naphthylamine; t-octylphenyl-alpha-naphthylamine; phenyl-alphanaphthylamine; phenyl-beta-naphthylamine; p-octyl phenyl-alpha-naphthylamine; 4-octylphenyl-l-octyl-beta-naphthylamine.

Typical of the dialkyl dithiophosphate salts which may be used are the zinc dialkyl dithiophosphates, especially the zinc dioctyl and zinc dibenzyl dithiophosphates. These salts are often used as anti-wear agents bu they have also been shown to possess antioxidant functionality, especially when used as a co-antioxidant in combination with an oil-soluble copper salt. Copper salts which may be used in this way as antioxidants in combination with the phosphorus and zinc compounds such as zinc dialkyl dithiophosphates include the copper salts of carboxylic adds such as stearic add, palmitic acid and oleic acid, copper phenates, copper sulfonates, copper acetylacetonates, copper naphthenates from naphthenic acids typically having a molecular weight of 200 to 500 and the copper dithiocarbamates and copper dialkyl dithiophosphates where the copper has been substituted for zinc. Copper slats of this type and their use as antioxidants are described in U.S. Pat. No. 4,867,890.

Normally, the total amount of antioxidant will not exceed 10 wt. % of the total composition and normally is rather less, below 5 wt. %. Usually, from 0.5 to 2 wt. % antioxidant is suitable although for certain applications more may be used if desired.

Inhibitor Package

An inhibitor package is used to provide the desired balance of anti-wear and anti-rust/ anti-corrosion properties. One component of this package is a substituted benzotriazolelamine phosphate adduct and the other is a tri-substituted phosphate, especially a triaryl phosphate such as cresyl diphenylphosphate, a known material which is commercially available. This component is typically present in minor amounts up to 5 wt. % of the composition. Normally less than 3% e.g. from 0.5 to 2 wt. % of the total composition is adequate to provide the desired anti-wear performance.

The second component of the anti-wear/anti-rust package is an adduct of benzotriazole or a substituted benzotriazole with an amine phosphate adduct which also provides anti-wear and anti oxidation performance. Certain multifunctional adducts of this kind (with aromatic amines) are described in U.S. Pat. No. 4,511,481 to which reference is made for a description of these adducts together with the method by which they may be prepared. Briefly, these adducts comprise a substituted benzotriazole of the formula

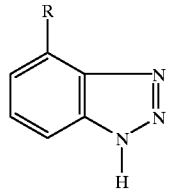

i.e. an alkyl-substituted benzotriazole where the substituent R is hydrogen or lower alkyl, $C_1$ to $C_6$, preferably $CH_3$. The preferred triazole is tolyl triazole (TTZ). For convenience, this component will be referred to as TTZ here although other benzotriazoles may also be used, as described in U.S. Pat. No. 4,511,481.

The amine component of the adduct may be an aromatic amine phosphate salt of the formula set out in U.S. Pat. No. 4,511,481 (HO)x—P(O)(O—NH3+—Ar)y where (x+y)=3 and Ar is an aromatic group. Alternatively, the main component may be an aliphatic amine salt, for example, a salt of an organoacid phosphate and an alkylamine such as a dialkylamine. The alkyl amine phosphate adducts may be made in the same way as the aromatic amine adducts. A preferred salt of this kind is the mono-/di-hexyl acid phosphate salt of long chain ($C_{11}$–$C_{14}$) alkylamines which can be made into an adduct with TTZ in this way for use in the present compositions. The adduct can range from 1:3 to 3:1 (mole) with the preferred adduct having a 75:25 ratio (weight) of the TTZ and the long chain alky/organoacid phosphate salt.

The TTZ amine phosphate salt adduct is typically used in relatively small amounts below about 5 wt. % and normally from about 0.1 to 1 wt. %, e.g. about 0.25 wt. %, is adequate when used in combination with the trihydrocarbyl phosphate, e.g. cresyl diphenylphosphate, component in order to give a good balance of anti-wear and anti-rust properties. Normally the CDP and the TTZ adduct are used in a weight ratio from 2:1 to 5:1.

Additional anti-rust additives may also be used. Metal deactivators which are commercially available and useful for this purpose, include, for example, the N,N-disubstituted aminomethyl-1,2,4-triazoles, and the N,N-disubstituted amino methyl-benzotriazoles. The N,N-disubstituted aminomethyl-1,2,4-triazoles can be prepared by a known method, namely be reacting a 1,2,4-triazole with formaldehyde and an amine, as described in U.S. Pat. No. 4,734,209. The N,N-disubstituted aminomethyl-benzotriazole can be similarly obtained by reacting a benzotriazole with formaldehyde and an amine, as described in U.S. Pat. No. 4,701, 273. Preferably, the metal deactivator is1-[bis(2-ethylhexyl) aminomethyl]-1,2,4-triazole or 1-[bis(2-ethylhexyl) aminomethyl]-4-methylbenzotriazole (adduct of tolyltriazole:formaldehyde:di-2-ethylhexylamine (1:1:1 m)), which are commercially available. Other rust inhibitors which may be used to confer additional rust protection include the succinimde derivatives such as the higher alkyl substituted amides of dodecylene succinic acid, which are also commercially, the higher alkyl substituted amides of dodecenyl succinic acid such as the tetrapropenylsuccinic monoesters (commercially available) and imidazoline succinic anhydride derivatives, e.g. the imidazoline derivatives of tetrapropenyl succinic anhydride. Normally, these additional rust inhibitors will be used in relatively small amounts below 2 wt. % although for certain applications e.g. in paper-making machinery oils, amounts up to about 5 wt. % may be employed if necessary.

The oils may also include other conventional additives, according to particular service requirements, for example dispersants, detergents, friction modifiers, traction improving additives, demulsifiers, defoamants, chromophores (dyes), haze inhibitors, according to application, all of which may be blended according to conventional methods using commercially available materials.

Performance

As noted above, the present lubricating oils have superior performance properties including, in particular, a combination of good anti-rust and anti-wear properties. This balance of performance properties is significant and is unexpectedly good for an oil based on a hydrocarbon base stock.

Good antiwear characteristics are indicated by performance in the FZG Scuffing test (DIN 51534), with fail stage values of at least 8, more usually in the range of 9 to 13 or even higher. The FZG test is indicative of performance for steel-on-steel contact as encountered in normal gear sets; good performance in this test indicates that good spur gear performance can be expected. The higher FZG test values are typically achieved with the higher viscosity grade oils, e.g. ISO 100 and higher will have an FZG value of 12 or higher, even 13 or higher, in comparison with values of 9 to 12 for grades below ISO 100. Values of 13 or higher (A/16.6/90) or 12 and higher (A/8.3/140) may be achieved with ISO grades of 300 and higher.

The anti-wear performance may also be indicated by a 4-Ball (ASTM D 4172) wear test value of not more than 0.35 mm maximum scar diameter (steel on steel, 1 hr, 180 rpm, 54° C., 20 kg.cm.$^{-2}$) with values of not more than 0.30 mm being readily attainable. 4-ball EP Weld values of 120 or higher, typically 150 or higher may be achieved. ASTM 4-Ball steel-on-bronze values of 0.07 mm (wear scar diameter) are typical.

The rust inhibition performance is indicated by a Pass in ASTM D 665B with synthetic sea water. Copper Strip Corrosion (ASTM D130) at 24 hours, 121° C., is typically 2A maximum, usually 1B or 2A.

Excellent high temperature oxidation performance is shown by a number of performance criteria including the Mobil catalytic oxidation test[1]. Test values of no more than 5 mg. KOH (ΔTAN, 163° C., 120 hrs.) are characteristic of the present compositions with values below 3 mg. KOH or even lower frequently—typically less than 0 mg. KOH—being obtainable. Viscosity increase in the catalytic oxidation test is typically not more than 15% and may be as low as 8–10%.

[1] In the catalytic oxidation test, 50 ml. of oil is placed in a glass all together with iron, copper, and aluminum catalysts and a weight lead corrosion specimen. The cell and its contents are placed in a bath maintained at 163° C. and 10 liters/hr of dried air is bubbled through the sample for 40 hours. The cell is removed from the bath and the catalyst assembly is removed from the cell. The oil is examined for the presence of sludge and the change in Neutralization Number (ASTM D 664) and Kinematic Viscosity at100° C. (ASTM D 445) are determined. The lead specimen is cleaned and weighed to determine the loss in weight.

Good oxidation resistance is also shown by the TOST values attained (ASTM D943) of at least 8,000 hours, usually at least 10,000 hours, with TOST sludge (1,000 hours) being no more than 0.020 wt. percent, usually no more than 0.015 wt. percent.

Applications

The lubricating oils of the present invention may be used for the lubrication of bearings, gears and in other industrial applications where wide temperature range characteristics are desired. The present oils are characterized by an excellent balance of performance properties including improved anti-wear characteristics coupled with anti-rust performance. They may find utility as gear oils, circulating oils, compressor oils as well as in other applications, for example, in wet clutch systems, blower bearings, coal pulverizer drives, cooling tower gearboxes, kiln drives, paper machine drives and rotary screw compressors. The particular lubricant performance characteristics required by these applications are illustrated by the following applications:

Coal pulverizer drives
deposit control
Cooling tower gearboxes
corrosion inhibition
Kiln drives
high temperature stability
Paper machine drives
high temperature, hydrolytic stability
Rotary screw compressors
extended oil life, deposit control

Examples 1–2

The following two oils are exemplary of the present formulations:

TABLE 1

Synthetic Oil Formulations

| Component | Example 1 | Example 2 |
|---|---|---|
| PAO, 5–6 cS | 23.07 | 16.07 |
| PAO, 100 cS | 53.00 | 61.01 |
| $C_{14}$ alk.-naphth. | 20.00 | 20.00 |
| Phenolic/non-phenolic anti-oxidant | 1.50 | 1.50 |
| CDP | 0.95 | 0.75 |
| TTZ/Amine phosphate | 0.25 | 0.25 |

TABLE 1-continued

| Synthetic Oil Formulations | | |
|---|---|---|
| Component | Example 1 | Example 2 |
| Ferrous/Non-ferrous corrosion inhibitor package[1] | 0.23 | 0.23 |
| Defoamant | 1.00 | |

Note:
1. Contains amine and alkyl ester mixed corrosion inhibitors

Example 3

An ISO grade 32 oil was made up as follows (wt. pct.):

TABLE 2

| ISO VG32 | |
|---|---|
| Component | |
| C14 alky. napth. | 20.00 |
| 40 cS PAO | 8.50 |
| 6 cS PAO | 68.28 |
| Amine antioxidant | 0.75 |
| CDP | 0.95 |
| Ferrous/Non-ferrous corrosion inhibitors[1] | 0.26 |
| TTZ/Amine phosphate | 0.25 |
| Defoamant package | 1.00 |
| Dye | 0.01 |

Note:
1. Contains amine and alkyl ester mixed corrosion inhibitors

The oil of Example 3 was tested in a number of standard tests and gave the following results shown in Table 3 below.

TABLE 3

| Test | Test Method | Result (Typical) |
|---|---|---|
| TAN | D664 | 0.42 |
| ASTM Rust B | D665B | Pass |
| Copper Strip, 24 hrs. @ 121° C. | D130 | 1B |
| TOST Sludge, 1000 hrs. | D943 | 0.015 |
| TOST Life | D943 | 10,000 |
| Cat. Ox., 120 hrs. @ 163° C., Vis. Inc. | | 10.0 |
| Cat. Ox., 120 hrs. @ 163° C., Change in TAN | | −0.3 |
| Cat. Ox., 120 hrs. @ 163° C., Sludge | | Light |
| RBOT, 150° C. | D2272 | 1,750 |
| FZG, Fail Stage | DIN51534 | 10 |

What is claimed is:

1. A lubricant oil composition having improved anti-wear and anti-rust performance characteristics, which comprises:

a base fluid which comprises at least 50 wt. % of a hydrocarbon base fluid; and an additive combination comprising:

(1) an adduct of a substituted triazole and a hydrocarbon amine phosphate in an amount below about 5 wt. % of the total composition and (2) a tri-hydrocarbyl phosphate in an amount up to 5 wt. % of the total composition, wherein the ratio of the ti-hydrocarbyl phosphate to the adduct is between about 2:1 to about 5:1.

2. A lubricant according to claim 1 in which the hydrocarbon base fluid comprises a hydrocarbon of lubricating viscosity and which is also saturated in character with a viscosity index of 110 or greater, a sulfur content generally below 0.3 weight percent and a total aromatics and olefinic content of below 10 weight percent each.

3. A lubricant according to claim 2 in which the hydrocarbon base fluid comprises a hydroisomerized wax of mineral origin or a hydroisomerized Fischer Tropsch wax.

4. A lubricant according to claim 1 in which the hydrocarbon base fluid comprises at least 50 weight percent of a polyalphaolefin synthetic hydrocarbon.

5. A lubricant according to claim 1 in which the hydrocarbon amine phosphate comprises an adduct of tolyl triazole and an alkylamine alkyl acid phosphate salt.

6. A lubricant according to claim 1 wherein the base fluid includes a long chain alkyl aromatic compound of lubricating viscosity in an amount up to 25 wt. % of the base fluid.

7. A lubricant according to claim 6 wherein the base fluid includes a long chain alkylated naphthalene as the alkyl aromatic compound in an amount up to 25 wt. % of the base fluid.

8. A lubricant according to claim 7 wherein the base fluid includes a long chain substantially mono-alkylated naphthalene having a $C_{10}$ to $C_{14}$ alkyl substituent in an amount up to 25 wt. % of the base fluid.

9. A lubricant according to claim 1 which has a 4-Ball (ASTM D 4172) wear test value of not more than 0.35 mm maximum scar diameter (steel on steel) and a rust inhibition performance of Pass in ASTM D 665 B.

10. A lubricant according to claim 1 which has a 4-Ball (ASTM D 4172) wear test value of not more than 0.30 mm maximum scar diameter (steel on steel) and a rust inhibition performance of Pass in ASTM D 665B.

11. A lubricant according to claim 1 which has an FZG Fail Stage (DIN 51354) of at least 10.

12. A lubricant according to claim 1 which has a TOST (ASTM D943) of at least 8,000 hours.

13. A lubricant according to claim 1 having, by weight percent:

| | |
|---|---|
| the base fluid comprising: | |
| a poly alpha olefin and | 65–80 |
| a long chain ($C_{10}$–$C_{16}$) monoalkylnaphthalene | 15–25 |
| the additive combination comprising: | |
| cresyl diphenyl phosphate | 0.5–5 |
| the tolyltriazole/alkylamine phosphate adduct | 0.1–1 |
| said lubricant including | |
| an antioxidant and | 0.5–5 |
| a ferrous/non-ferrous corrosion inhibitor | 0.1–1. |

14. A lubricant according to claim 13 in which the antioxidant comprises from 0.1 to 1 percent each of a phenolic antioxidant and an aromatic amine antioxidant.

15. A lubricant according to claim 13 in which the amount of cresyl diphenyl phosphate is from 0.5 to 1.0 percent.

16. A lubricant according to claim 13 in which the amount of tolyltriazole/alkylamine phosphate adduct is from 0.1 to 0.5 percent.

17. A lubricant according to claim 13 in which the amount of the ferrous/non-ferrous corrosion inhibitor is from 0.1 to 0.5 percent.

18. A lubricant according to claim 15 in which the amount of the tolyltriazole/alkylamine phosphate adduct is from 0.1 to 0.5 percent.

19. A method of enhancing the operation of a wet clutch system, machine drive, or rotary screw compressor by using the lubricant according to claim 1.

20. A method of using the lubricant according to claim 1 as a gear oil, a circulating oil, or a compressor oil.

* * * * *